US009310763B2

(12) United States Patent
Hata et al.

(10) Patent No.: US 9,310,763 B2
(45) Date of Patent: Apr. 12, 2016

(54) IMAGE FORMING DEVICE HAVING INTAKE DUCT

(71) Applicants: Yohsuke Hata, Nagoya (JP); Naoto Ozeki, Konan (JP)

(72) Inventors: Yohsuke Hata, Nagoya (JP); Naoto Ozeki, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/224,416

(22) Filed: Mar. 25, 2014

(65) Prior Publication Data

US 2014/0294426 A1 Oct. 2, 2014

(30) Foreign Application Priority Data

Mar. 29, 2013 (JP) ..... 2013-070887

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92
See application file for complete search history.

(56) References Cited

U.S. PATENT DOCUMENTS

| | | | | |
|---|---|---|---|---|
| 5,291,247 | A * | 3/1994 | DeCecca | 399/92 |
| 6,219,504 | B1 * | 4/2001 | Matsuzaki et al. | 399/92 |
| 2005/0232653 | A1 * | 10/2005 | Murooka | 399/92 |
| 2005/0238379 | A1 | 10/2005 | Ogane et al. | |
| 2006/0120748 | A1 | 6/2006 | Takehara et al. | |
| 2007/0019981 | A1 * | 1/2007 | Kawamata | 399/92 |
| 2008/0187349 | A1 * | 8/2008 | Yoshihara et al. | 399/92 |
| 2009/0060560 | A1 * | 3/2009 | Tamura | G03G 15/0815 399/92 |
| 2011/0123215 | A1 * | 5/2011 | Nishimura et al. | 399/92 |
| 2011/0274463 | A1 * | 11/2011 | Taguchi | G03G 21/206 399/122 |

FOREIGN PATENT DOCUMENTS

| | | | | |
|---|---|---|---|---|
| JP | 3-105366 | A | 5/1991 | |
| JP | 11218987 | A * | 8/1999 | G03G 15/00 |
| JP | 2000-47551 | A | 2/2000 | |
| JP | 2001-318577 | A | 11/2001 | |
| JP | 2003-76253 | A | 3/2003 | |
| JP | 2004294949 | A * | 10/2004 | |
| JP | 2005-17881 | A | 1/2005 | |
| JP | 2005-315917 | A | 11/2005 | |
| JP | 2006-139219 | A | 6/2006 | |
| JP | 2006-139220 | A | 6/2006 | |
| JP | 2006-184436 | A | 7/2006 | |
| JP | 2009-25387 | A | 2/2009 | |
| JP | 2009-169308 | A | 7/2009 | |

* cited by examiner

*Primary Examiner* — Billy Lactaoen
(74) *Attorney, Agent, or Firm* — Merchant & Gould P.C.

(57) ABSTRACT

An image forming device includes: an image forming unit; an enclosure; and an intake duct. The image forming unit includes a photosensitive member having an axis. The enclosure is configured to house the image forming unit and includes a first wall provided on one side of the image forming unit with respect to a first direction parallel to the axis. An air intake is formed in the first wall to allow air communication between an interior and an exterior of the enclosure. The intake duct is elongated in the first direction. Air drawn in through the air intake flows into the intake duct. The intake duct includes an opposing part. The opposing part opposes the image forming unit in a second direction perpendicular to the first direction. An opening is formed in the opposing part. Air introduced into the intake duct flows toward the image forming unit through the opening.

13 Claims, 7 Drawing Sheets

IMAGE FORMING DEVICE HAVING INTAKE DUCT

CROSS REFERENCE TO RELATED APPLICATION

This application claims priority from Japanese Patent Application No. 2013-070887 filed Mar. 29, 2013. The entire content of the priority application is incorporated herein by reference.

TECHNICAL FIELD

The present invention relates to an image forming device.

BACKGROUND

One image forming device known in the art has an electrophotographic image forming unit housed in an enclosure. The image forming unit has a photosensitive member that rotates about its shaft. Toner is supplied to the photosensitive member to form a toner image thereon. The enclosure includes a first wall provided on one side of the image forming unit with respect to a first direction parallel to the shaft of the photosensitive member. An air intake is formed in the first wall to allow air communication between the interior and exterior of the enclosure.

With this conventional image forming device, external air enters the enclosure through the air intake and flows toward the opposite side of the enclosure in the first direction. The air flows over the image forming unit at this time so as to cool the unit (Japanese Patent Application Publication No. 2005-17881, for example).

SUMMARY

However, in the conventional image forming device described above, air flowing to the first end of the image forming unit in the first direction tends to be unheated air that has just been introduced into the enclosure, while air flowing to the other end of the image forming unit in the first direction tends to be air that has been heated in the enclosure. Accordingly, the cooling effect on the image forming unit tends to be non-uniform along the first direction.

In view of the foregoing, it is an object of the present invention to provide an image forming device capable of cooling the image filming unit uniformly along a first direction parallel to the shaft of the photosensitive member.

In order to attain the above and other objects, the present invention provides an image forming device that includes: an image forming unit; an enclosure; and an intake duct. The image forming unit includes: a photosensitive member; and a toner supply member. The photosensitive member is configured to rotate about an axis. The toner supply member is configured to supply toner to the photosensitive member to form a toner image thereon. The enclosure is configured to house the image forming unit and includes a first wall. The first wall is provided on one side of the image forming unit with respect to a first direction parallel to the axis. An air intake is formed in the first wall to allow air communication between an interior and an exterior of the enclosure. The intake duct is elongated in the first direction inside the enclosure. Air drawn in through the air intake flows into the intake duct. The intake duct includes an opposing part. The opposing part opposes the image forming unit in a second direction perpendicular to the first direction. An opening is formed in the opposing part. Air introduced into the intake duct flows toward the image forming unit through the opening.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, preferred embodiment of the present invention will be described while referring to the accompanying drawings.

Figure 1:
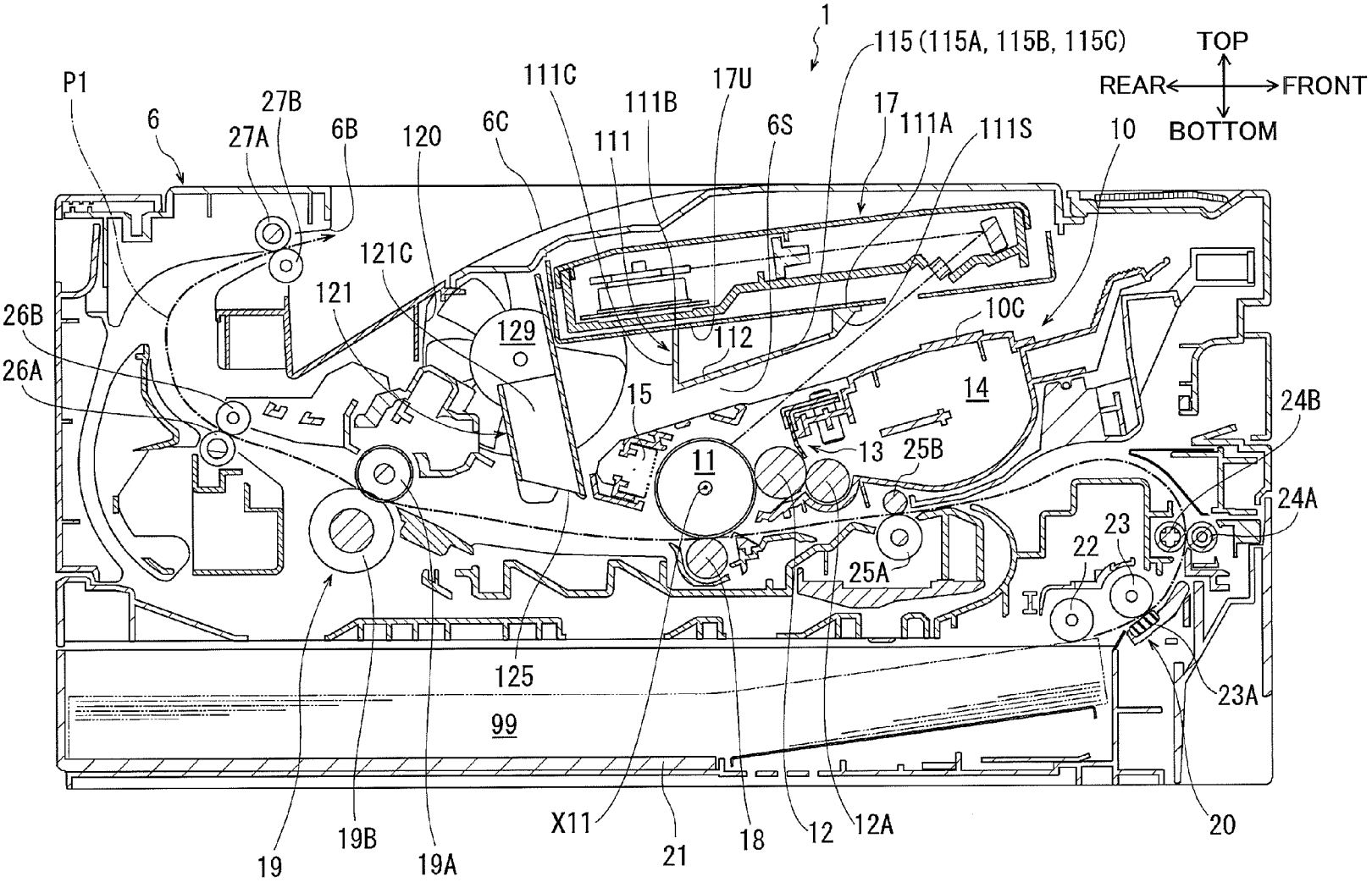
FIG. 1 is a schematic cross-sectional view illustrating an image forming device according to a first embodiment of the present invention.

FIG. 1 shows an image forming device 1 according to a first embodiment of the present invention. The image forming device 1 is a monochrome laser printer that employs an electro-photographic system to form monochromatic images on sheets 99 of paper, transparencies, or the like. The right side of the image forming device 1 in FIG. 1 is defined as the front, and the near side of the image forming device 1 in FIG. 1 (i.e., the side on the left of an observer facing the front of the device) is defined as the left side. Arrows are provided in all drawings to indicate the forward, rearward, leftward, rightward, upward, and downward directions. Directions indicated in FIG. 2 and subsequent drawings correspond to the directions indicated in FIG. 1. Next, the components of the image forming device 1 will be described with reference to the drawings.

Figure 2:
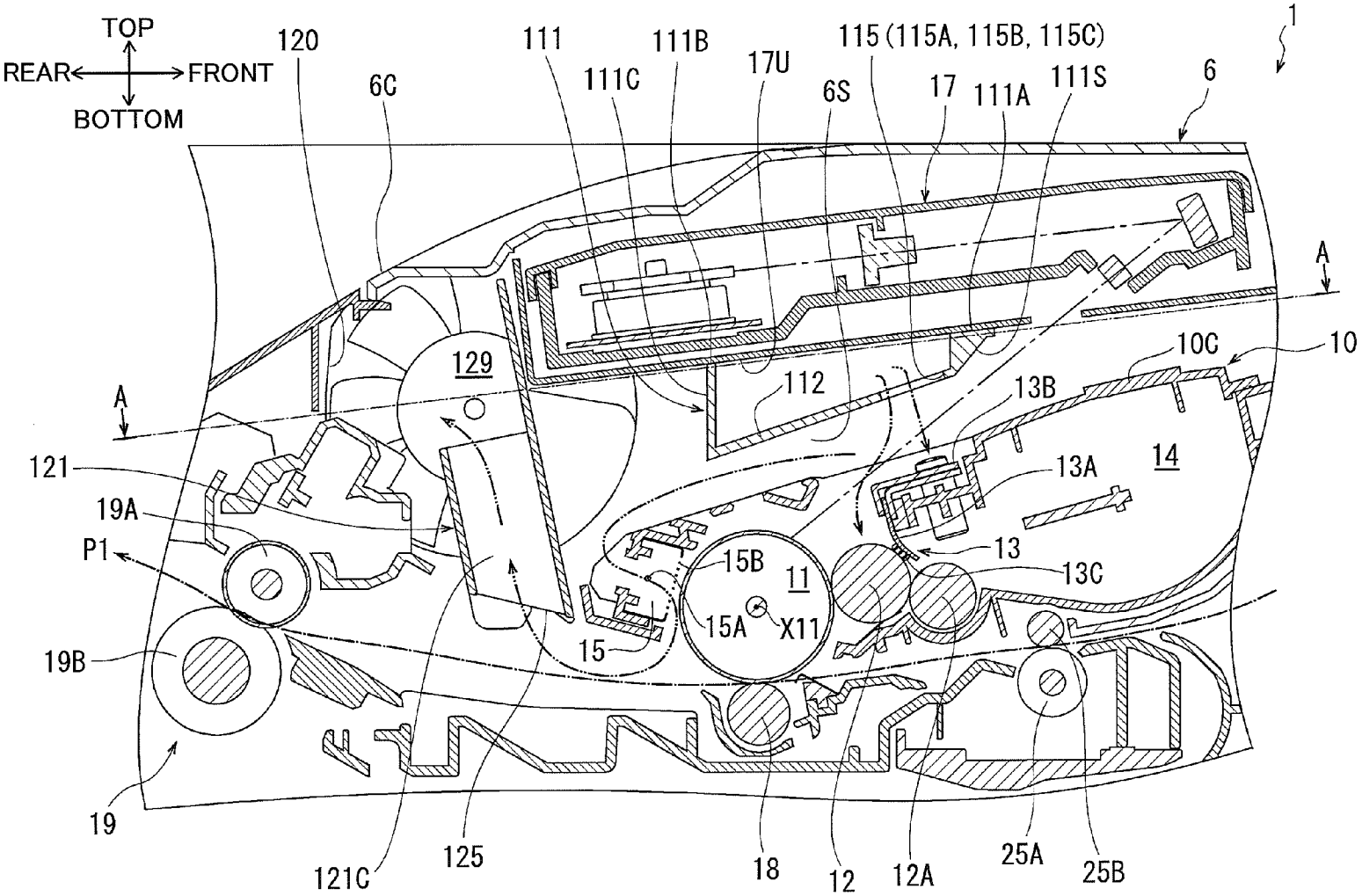
FIG. 2 is a partial enlarged cross-sectional view illustrating the image forming device according to the first embodiment.
Figure 3:
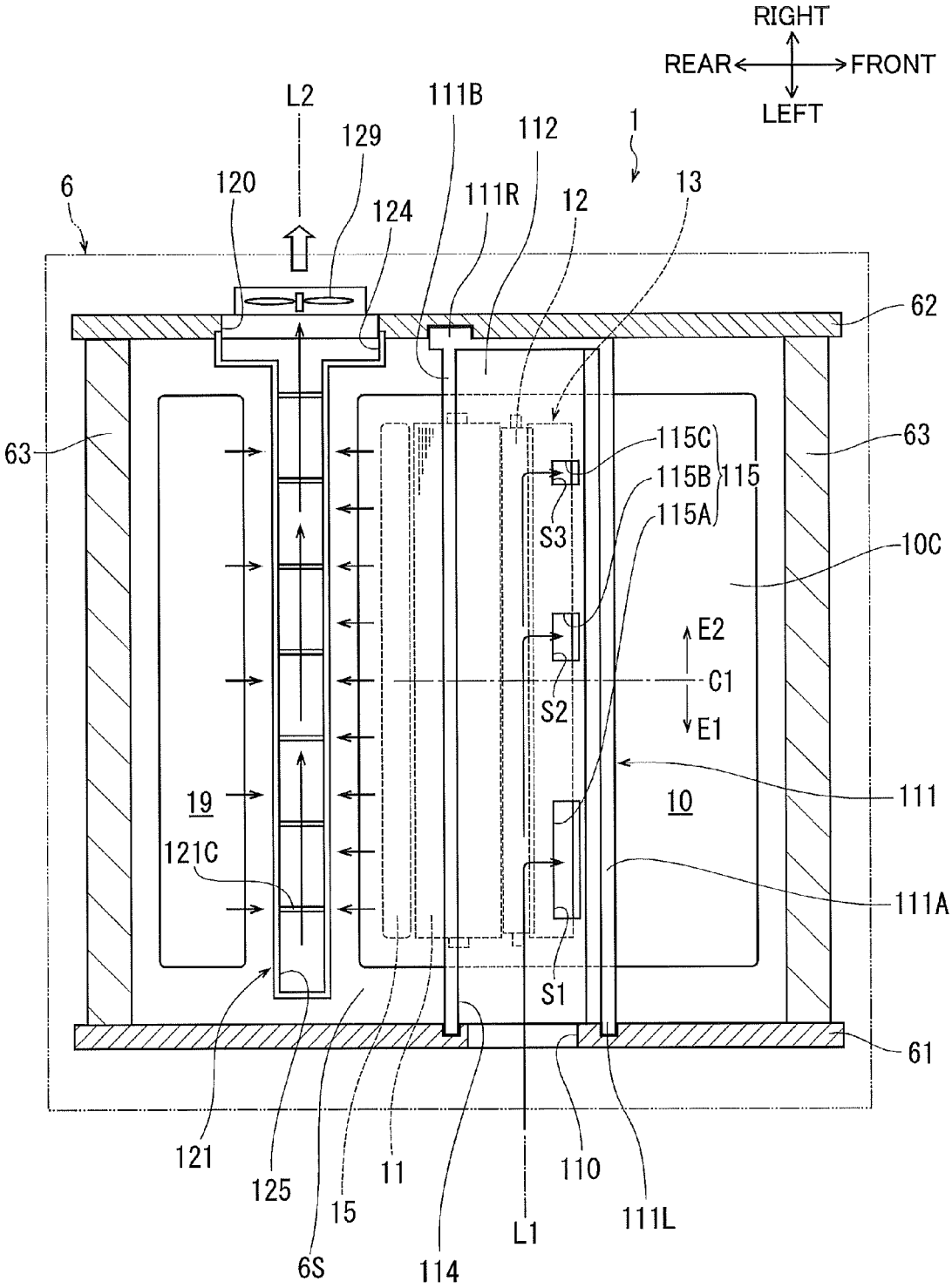
FIG. 3 is a partial enlarged cross-sectional view of the image forming device according to the first embodiment taken along a plane A-A shown in FIG. 2.

As shown in FIGS. 1 through 3, the image forming device 1 is provided with a box-like enclosure 6. The enclosure 6 constitutes the outer casing of the image forming device 1. As shown in FIG. 3, the enclosure 6 includes a first wall 61 and a second wall 62. The first wall 61 is disposed inside the enclosure 6 along the left side of the enclosure 6. The second wall 62 is disposed inside the enclosure 6 along the right side of the enclosure 6.

The first and second walls 61 and 62 have a general plate shape that expands in both front-rear and vertical directions. The enclosure 6 also includes two linking segments 63 that couple corresponding front and rear ends of the first and second walls 61 and 62. The interior of the enclosure 6 between the first and second walls 61 and 62 in the left-right direction is defined as an accommodating section 6S. With the linking segments 63, the first and second walls 61 and 62 construct a frame for supporting a process unit 10 and an exposure unit 17 described later.

As shown in FIG. 1, a sheet cassette 21 is removably provided in the image forming device 1 beneath the accommodating section 6S. The sheet cassette 21 has a box-like shape with an open top and serves to accommodate a plurality of stacked sheets 99.

The enclosure 6 is also provided with a discharge tray 6C, and a sheet discharge opening 6B. The discharge tray 6C is a depression formed in the top surface of the enclosure 6 that slopes downward toward the rear side. The sheet discharge opening 6B is formed above the rear end of the discharge tray 6C and provides communication between the accommodating section 6S and the exterior of the enclosure 6.

The image forming device 1 also includes a conveying unit 20. The conveying unit 20 includes a sheet-conveying path P1 formed through the interior of the enclosure 6 and, disposed along the sheet-conveying path P1, a feeding roller 22, a separating roller 23, a separating pad 23A, a first pair of conveying rollers 24A and 24B, a second pair of conveying rollers 25A and 25B, a third pair of conveying rollers 26A and 26B, and a pair of discharge rollers 27A and 27B.

The sheet-conveying path P1 extends first upward and forward from the front end of the sheet cassette 21, then follows a general U-shaped course to change the conveying direction to the rearward direction. Next, after advancing rearward along a general horizontal path, the sheet-conveying path P1 extends upward and rearward, then follows a general U-shaped course to change the conveying direction to the forward direction. Lastly, the sheet-conveying path P1 continues through the sheet discharge opening 6B to arrive at the discharge tray 6C.

The feeding roller 22, separating roller 23, and separating pad 23A are arranged on the front end of the sheet cassette 21. The feeding roller 22, separating roller 23, and separating pad 23A operate in conjunction to convey sheets 99 from the sheet cassette 21 one at a time.

The conveying rollers 24A and 24B are disposed on the first U-shaped section of the sheet-conveying path P1 at which the conveying direction changes to the rearward direction. The conveying rollers 25A and 25B are disposed on the horizontal section of the sheet-conveying path P1. The conveying rollers 26A and 26B and the discharge rollers 27A and 27B are arranged on the second U-shaped section of the sheet-conveying path P1 at which the conveying direction changes to the forward direction. The discharge rollers 27A and 27B are positioned adjacent to the sheet discharge opening 6B.

The conveying unit 20 having the configuration described above conveys sheets 99 accommodated in the sheet cassette 21 one at a time along the sheet-conveying path P1. After passing through the sheet-conveying path P1, each sheet 99 is discharged from the enclosure 6 through the sheet discharge opening 6B and received in the discharge tray 6C.

The conveying direction in the preferred embodiment is defined as the direction from the sheet cassette 21 to the discharge tray 6C that follows the sheet-conveying path P1. Hence, the sheet cassette 21 is positioned on the most upstream side in the conveying direction, while the discharge tray 6C is positioned on the most downstream side in the conveying direction.

As shown in FIGS. 1 through 3, the image forming device 1 is further provided with a process unit 10 that is accommodated in the accommodating section 6S, as well as an exposure unit 17, a transfer roller 18, and a fixing unit 19 disposed in the enclosure 6. The process unit 10 in the preferred embodiment is an example of an image forming unit according to the present invention.

The process unit 10 is disposed on the upstream side of the horizontal section of the sheet-conveying path P1. The process unit 10 has a photosensitive drum 11, a case 10C, a developing roller 12, a supply roller 12A, blade 13, a toner-accommodating section 14, and a charger 15. The photosensitive drum 11 in the preferred embodiment is an example of a photosensitive member according to the present invention.

The case 10C has a box-like shape that has been flattened vertically. The case 10C extends from a position near the front side of the enclosure 6 to a position near the front-rear center of the enclosure 6. In the left-right direction, the case 10C extends from a position near the first wall 61 on the left side to a position near the second wall 62 on the right side.

The photosensitive drum 11 is a cylinder that is elongated in the left-right direction. The photosensitive drum 11 is supported in the case 10C so as to be capable of rotating about a shaft X11. The shaft X11 is oriented in the left-right direction and positioned in the front-rear center region of the enclosure 6. When a sheet 99 is conveyed along the horizontal section of the sheet-conveying path P1, the photosensitive drum 11 rotates in contact with the top surface of the sheet 99.

The left-right direction parallel to the orientation of the shaft X11 is an example of a first direction of the present invention. The first wall 61 is disposed on one side (the left side) of the process unit 10 in the first direction parallel to the shaft X11, while the second wall 62 is disposed on the other side (the right side) of the process unit 10 in the first direction.

The developing roller 12 is supported in the process unit 10 so as to be capable of rotating about a shaft oriented parallel to the shaft X11. The developing roller 12 confronts the front side of the photosensitive drum 11.

The toner-accommodating section 14 is formed in the case 10C on the front side of the developing roller 12. The toner-accommodating section 14 functions to accommodate toner. The supply roller 12A supplies toner from the toner-accommodating section 14 onto the developing roller 12. While the developing roller 12 rotates in contact with the photosensitive drum 11, toner deposited on the developing roller 12 is supplied onto the photosensitive drum 11.

As shown in the enlarged view of FIG. 2, the blade 13 is configured of a blade body 13A, and a support part 13B. The support part 13B includes two overlapped metal plate members having an L-shaped cross section. Specifically, the plate members of the support part 13B first extend rearward, then bend and protrude downward. The support part 13B is fixed to the top surface of the case 10C with screws. The blade body 13A is interposed between the downward-protruding portions of the two plate members constituting the support part 13B. The blade body 13A is formed of an elastic metal plate. The blade body 13A has a rubber scraping part 13C on the portion of the blade body 13A that contacts the developing roller 12 for scraping excess toner from the developing roller 12.

The charger 15 is disposed in the case 10C on the rear side of the photosensitive drum 11. The charger 15 is a scorotron-type charger that includes a charging wire 15A, and a grid electrode 15B. The charger 15 is positioned near the photosensitive drum 11 and is elongated in the left-right direction for positively charging the entire surface of the photosensitive drum 11 without contacting the surface.

The process unit 10 is detachably mounted in the enclosure 6 and can be removed when the process unit 10 has run out of toner or when components need to be replaced. While not shown in the drawings, the front surface of the enclosure 6 can be opened from the state shown in FIG. 1, and the process unit 10 can be removed from the enclosure 6 by pulling the process unit 10 in a forward direction.

As shown in FIGS. 1 and 2, the exposure unit 17 is disposed above the process unit 10, with a space allocated between the exposure unit 17 and process unit 10 so that the exposure unit 17 does not interfere with the process unit 10 when the process unit 10 is mounted in and removed from the enclosure 6. An underside surface 17U of the exposure unit 17 forms the upper wall that defines the accommodating section 6S. The exposure unit 17 includes a laser light source, a polygon mirror, an fθ lens, reflecting mirrors, and the like. The exposure unit 17 exposes the photosensitive drum 11 by irradiating a laser beam onto the photosensitive drum 11 after the charger 15 has applied a uniform positive charge to the surface of the photosensitive drum 11. Through this process, the exposure unit 17 forms an electrostatic latent image on the photosensitive drum 11. The developing roller 12 supplies toner onto this latent image in order to form a toner image on the photosensitive drum 11.

The transfer roller 18 is disposed on the underside of the horizontal section of the sheet-conveying path P1. The transfer roller 18 confronts the bottom of the photosensitive drum 11. The transfer roller 18 can rotate about a shaft that is oriented parallel to the shaft X11. While a sheet 99 is nipped between the photosensitive drum 11 and transfer roller 18, the photosensitive drum 11 and transfer roller 18 convey the sheet 99 downstream in the conveying direction along the horizontal section of the sheet-conveying path P1. At this time, a negative charge is applied to the transfer roller 18 to transfer toner carried on the photosensitive drum 11 to the sheet 99.

As shown in FIGS. 1 through 3, the fixing unit 19 is disposed near the rear side of the enclosure 6 on the downstream side of the process unit 10 in the conveying direction. The fixing unit 19 has a heating roller 19A, and a pressure roller 19B positioned below the heating roller 19A. The heating roller 19A and pressure roller 19B confront each other from opposing sides of the sheet-conveying path P1. After a sheet 99 has passed between the photosensitive drum 11 and transfer roller 18 and becomes nipped between the heating roller 19A and pressure roller 19B, the fixing unit 19 applies heat and pressure to the sheet 99, causing the toner to melt and become fixed to the sheet 99.

After an image has been formed on the sheet 99 in this way, the conveying rollers 26A and 26B convey the sheet 99 to the discharge rollers 27A and 27B, and the discharge rollers 27A and 27B discharge the sheet 99 through the sheet discharge opening 6B onto the discharge tray 6C. Hence, the discharge tray 6C retains sheets 99 on which images have been formed.

With the structure described below, the image forming device 1 according to the first embodiment can cool the process unit 10 effectively.

Figure 4:
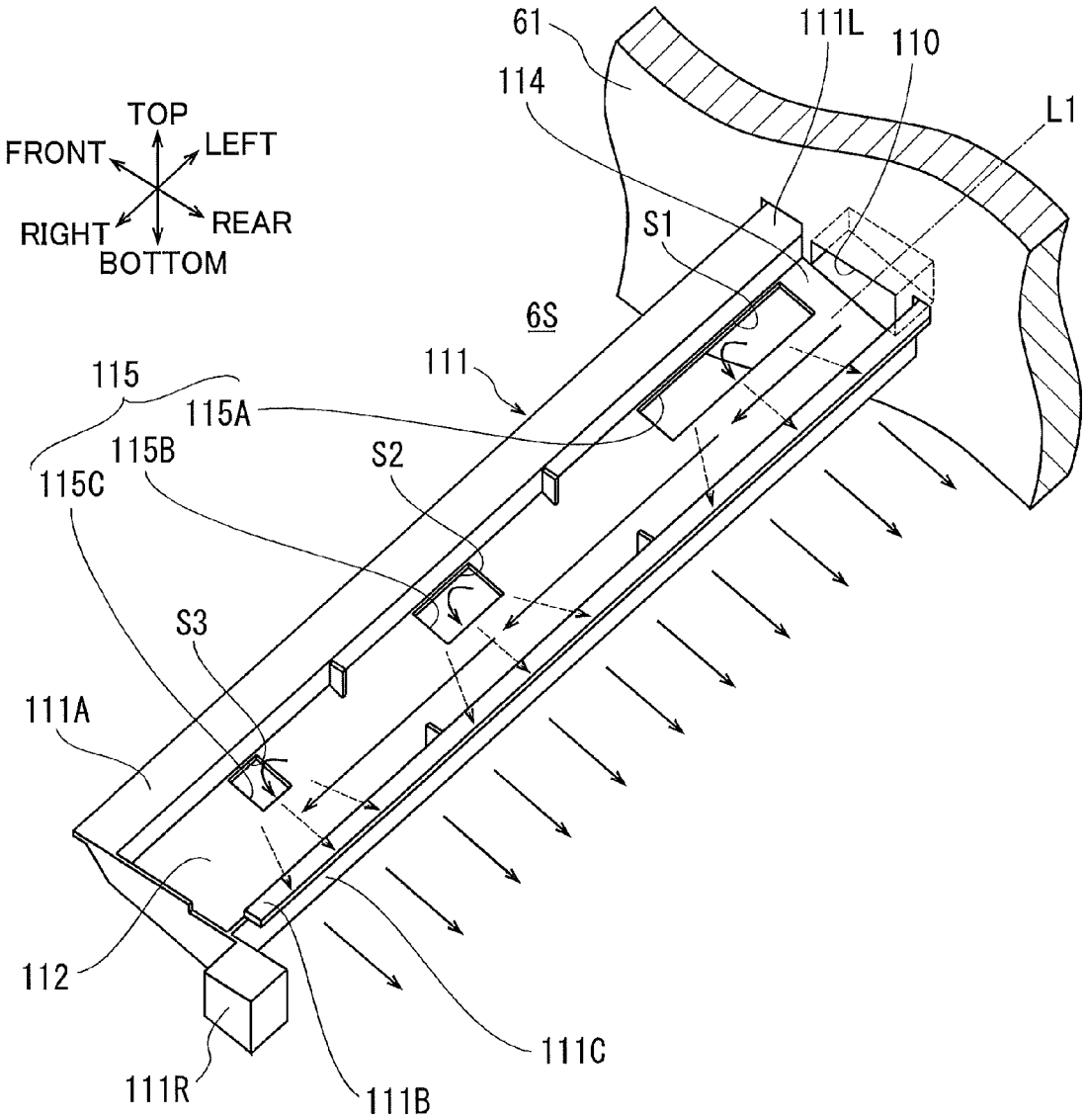
FIG. 4 is a partial perspective view of an intake duct provided in the image forming device according to the first embodiment.

As shown in FIGS. 3 and 4, an air intake 110 is formed in the first wall 61. The air intake 110 penetrates the first wall 61 in the left-right direction to provide air communication between the interior and exterior of the enclosure 6. Although not shown in the drawings, a plurality of slits is formed in the outer casing constituting the left side of the enclosure 6 at positions corresponding to the air intake 110.

As shown in FIGS. 1 through 3, an air outlet 120 is formed in the second wall 62. The air outlet 120 penetrates the second wall 62 in the left-right direction to provide air communication between the interior and exterior of the enclosure 6. Although not shown in the drawings, a plurality of slits is formed in the outer casing constituting the right side of the enclosure 6 at positions corresponding to the air outlet 120.

The image forming device 1 is further provided with a discharge fan 129, an intake duct 111, and a discharge duct 121.

The discharge fan 129 is provided between the air outlet 120 and the right side of the enclosure 6. The discharge fan 129 functions to discharge air from the air outlet 120, thereby generating negative pressure in the accommodating section 6S so that air outside the enclosure 6 is drawn into the accommodating section 6S through the air intake 110. The discharge fan 129 is also positioned between the process unit 10 and the fixing unit 19 with respect to the front-rear direction.

As shown in FIGS. 1 through 5, the intake duct 111 is a resinous member extending in the left-right direction inside the accommodating section 6S. As shown in FIG. 2, the intake duct 111 is disposed between the exposure unit 17 and the process unit 10. The intake duct 111 is fixed to the underside surface 17U of the exposure unit 17 such that a front edge 111A extending in the left-right direction and a rear edge 111B extending in the left-right direction and positioned rearward of the front edge 111A are in contact with the underside surface 17U of the exposure unit 17. In other word, the underside surface 17U of the exposure unit 17 forms the top surface of the intake duct 111.

As shown in FIGS. 3 and 4, a left end 111L of the intake duct 111 is engaged in the first wall 61 on the left side of the enclosure 6, while a right end 111R of the intake duct 111 is engaged in the second wall 62 provided on the right side of the enclosure 6.

As shown in FIG. 2, the intake duct 111 has a sloped surface 111S, an opposing part 112, and a rear surface 111C.

The sloped surface. 111S slopes from the front edge 111A downward toward the rear. Hence, while sloping toward the rear, the sloped surface 111S approaches the top surface of the case 10C. The sloped surface 111S is positioned slightly forward of the blade 13.

The opposing part 112 extends continuously rearward from the bottom edge of the sloped surface 111S at a more gradual slope than the sloped surface 111S. The opposing part 112 vertically opposes the process unit 10. The vertical direction in the preferred embodiment is an example of a second direction according to the present invention.

The rear surface 111C extends downward from the rear edge 111B and is formed continuously with the rear edge of the opposing part 112. The rear surface 111C is positioned slightly rearward of the shaft X11.

As shown in FIGS. 3 and 4, the air intake 110 is provided on an extended line L1 that passes through the intake duct 111 in the left-right direction. An intermediate air intake 114 is formed in the left end 111L of the intake duct 111 and is open to and in communication with the air intake 110. Accordingly, air drawn in through the air intake 110 flows into the intake duct 111 through the intermediate air intake 114.

As shown in FIGS. 2 through 5, openings 115 are formed in the opposing part 112. The openings 115 include a rectangular hole 115A formed in the left side of the opposing part 112, a rectangular hole 115B formed in the center region of the opposing part 112, and a rectangular hole 115C formed in the right side of the opposing part 112. Hence, the openings 115 are formed from a position in the accommodating section 6S near the first wall 61 on the left side to a position near the second wall 62 on the right side.

Figure 5:
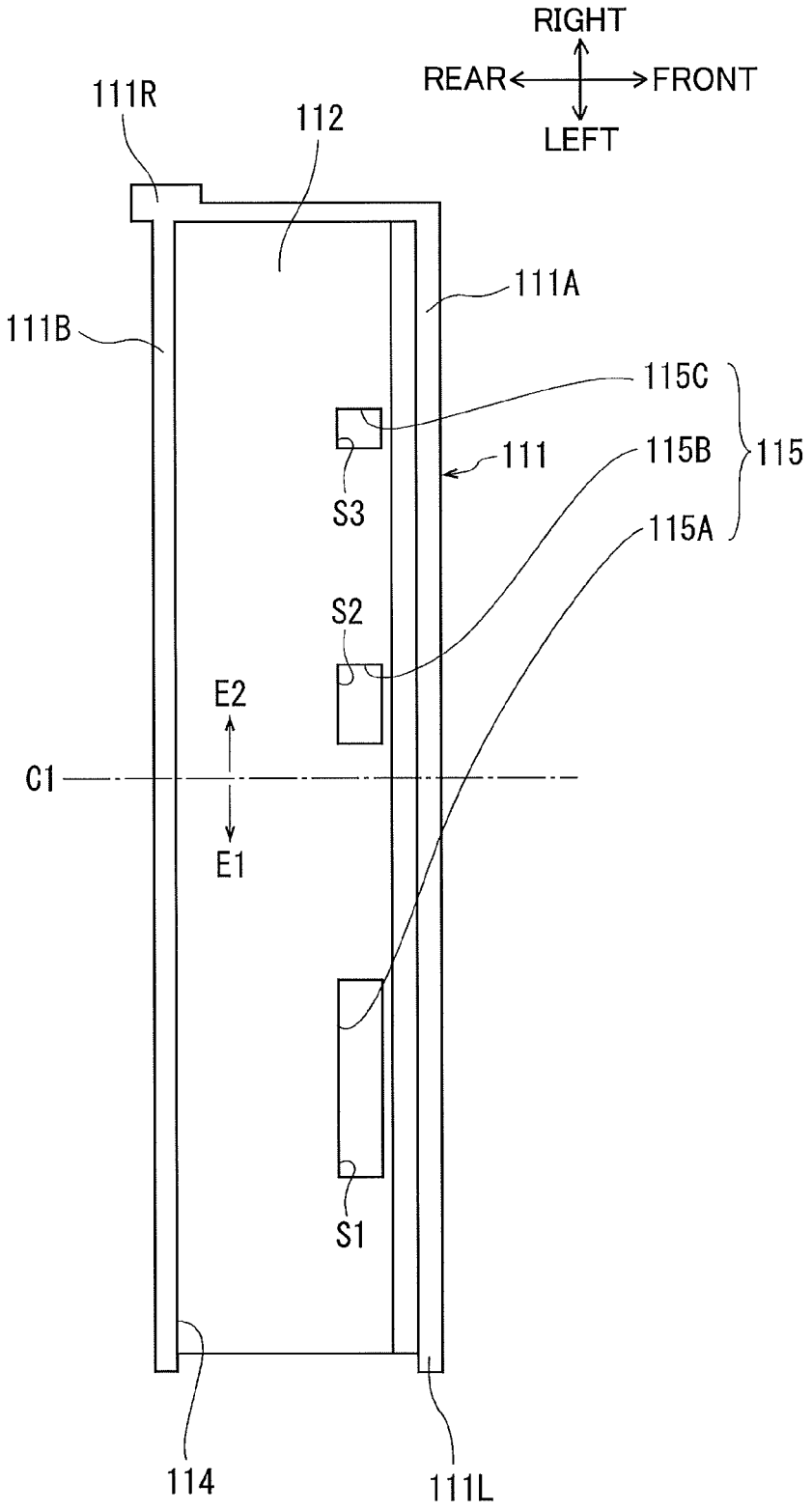
FIG. 5 is a top view of the intake duct in the image forming device according to the first embodiment.

As shown in FIGS. 3 and 5, a centerline C1 passes through the left-right center of the photosensitive drum 11. The openings 115 are divided among a first region E1 on the left side of the centerline C1 and a second region E2 on the right side of the centerline C1. The open area of the opening 115 in the first region E1 is the area S1 of the rectangular hole 115A, while the open area of the openings 115 in the second region E2 is the sum of the area S2 of the rectangular hole 115B and the area S3 of the rectangular hole 115C. Here, the area S1 in the first region E1 is greater than the sum of areas S2 and S3 in the second region E2.

As shown in FIGS. 2 and 3, the rectangular holes 115A, 115B and 115C constituting the openings 115 vertically oppose the support part 13B of the blade 13. As shown in FIGS. 2 through 4, air introduced into the intake duct 111 flows toward the support part 13B in the process unit 10 through the rectangular holes 115A, 115B and 115C. After flowing over the blade body 13A, scraping part 13C, and developing roller 12, this air flows toward the photosensitive drum 11 and the grid electrode 15B of the charger 15 positioned to the rear of the blade 13.

As shown in FIGS. 2 and 3, the discharge duct 121 is disposed downstream of the intake duct 111 in the conveying direction and is offset toward the rear wall of the enclosure 6. The discharge duct 121 is also positioned between the process unit 10 and the fixing unit 19 and forms the rear wall defining the accommodating section 6S. The discharge duct 121 extends in the left-right direction from the second wall 62 on the right side of the enclosure 6 to a position near the first wall 61 on the left side.

A discharge opening 125 is formed in the bottom end of the discharge duct 121. The discharge opening 125 is formed in the rear end of the accommodating section 6S and spans from a position near the second wall 62 on the right to a position near the first wall 61 on the left. The discharge opening 125 is adjacent to the charger 15 on the rear side thereof. Air flowing through the openings 115 toward the blade 13 in the process unit 10 first flows around the blade body 13A, scraping part 13C, and developing roller 12 and then passes around the grid electrode 15B of the charger 15 and the photosensitive drum 11. This air subsequently flows into the discharge duct 121 through the discharge opening 125. Air around the fixing unit 19 also enters the discharge duct 121 through the discharge opening 125.

A plurality of partitioning plates 121C is formed inside the discharge duct 121. The partitioning plates 121C are arranged at intervals in the left-right direction and extend to positions above the discharge opening 125. Air flowing into the discharge duct 121 through the discharge opening 125 is guided by the partitioning plates 121C while flowing upward. The partitioning plates 121C change the direction of flow to the right so that air flows toward the air outlet 120.

As shown in FIG. 3, the air outlet 120 is provided along an extended line L2 passing through the discharge duct 121 in the left-right direction. An intermediate air outlet 124 is formed in the right end of the discharge duct 121. The intermediate air outlet 124 is open to and in communication with the air outlet 120. With this configuration, air in the accommodating section 6S flows into the discharge duct 121 via the discharge opening 125 and is discharged from the air outlet 120 by the discharge fan 129.

With the image forming device 1 according to the first embodiment described above, air introduced into the accommodating section 6S through the air intake 110 flows through the intake duct 111 that extends from the first wall 61 to the second wall 62 in the left-right direction, as shown in FIGS. 2 through 4. The intake duct 111 has an opposing part 112 that vertically opposes the process unit 10, and the openings 115 formed in the opposing part 112. Specifically, the openings 115 are configured of the rectangular holes 115A, 115B and 115C formed across the opposing part 112 from a position in the accommodating section 6S near the first wall 61 on the left to a position in the accommodating section 6S near the second wall 62 on the right. Air in the intake duct 111 flows through the rectangular hole 115A disposed on the left, the rectangular hole 115B disposed in the center, and the rectangular hole 115C disposed on the right toward the blade 13 in the process unit 10. This construction ensures that the air passing through the openings 115 toward the process unit 10 flows more uniformly over the process unit 10 with respect to the left-right direction.

Therefore, the image forming device 1 according to the first embodiment can cool the process unit 10 uniformly across the left-right direction parallel to the shaft X11 of the photosensitive drum 11.

In the image forming device 1 described above, the air intake 110 and the intermediate air intake 114 of the intake duct 111 are in direct confrontation with each other in the left-right direction. Therefore, very little channel resistance acts on air flowing into the intake duct 111 through the air intake 110, improving the intake efficiency of the intake duct 111.

Further, providing the air outlet 120 and discharge fan 129 on the second wall 62 disposed on the end of the intake duct 111 opposite the first wall 61 in which the air intake 110 is formed ensures a more uniform flow of air across the process unit 10 from the left end to the right.

Furthermore, the area S1 of the openings 115 in the first region E1 of the opposing part 112 is greater than the sum of areas S2 and S3 of openings 115 in the second region E2.

If the open area of openings 115 in the first region E1 were identical to that in the second region E2, the negative pressure generated by the discharge fan 129 would cause air to more likely be discharged from the second region E2, which is closer to the discharge fan 129 than the first region E1. Thus, by setting the area S1 in the first region E1 greater than the sum of areas S2 and S3 in the second region E2, the present invention can ensure that air discharged from the rectangular hole 115A in the first region E1 is consistent with the air discharged from the rectangular holes 115B and 115C in the second region E2.

The discharge opening 125 is formed in the rear end of the accommodating section 6S and spans from a position near the second wall 62 on the right side to a position near the first wall 61 on the left side. With this configuration, the image forming device 1 can uniformly discharge air over the process unit 10 from the left end to the right end thereof.

Further, since the air outlet 120 and the intermediate air outlet 124 formed in the discharge duct 121 are in direct opposition with each other in the left-right direction, there is little channel resistance acting on air circulating in the discharge duct 121 that is discharged from the air outlet 120. Thus, this construction improves the discharging efficiency of the discharge duct 121.

Since the photosensitive drum 11 and the like heat the sheet 99 when transferring a toner image thereon, heated air tends to rise on the downstream side of the sheet 99 with respect to the conveying direction. For this reason, the discharge duct 121 of the image forming device 1 is arranged in a position offset downstream of the intake duct 111 in the conveying direction, enabling the discharge duct 121 to more effectively discharge heated air.

Further, since the discharge duct 121 is disposed between the process unit 10 and the fixing unit 19, the discharge duct 121 can effectively discharge air that has been heated in the fixing unit 19. Furthermore, the discharge duct 121 can thermally isolate the process unit 10 and fixing unit 19.

When the image forming device 1 performs high-speed image formation, the developing roller 12 is required to rotate at a high speed. This high-speed rotation produces friction between the toner on the developing roller 12 and the scraping part 13C of the blade 13. The friction generates heat in the blade 13, which can degrade the toner. However, since the openings 115 in the image forming device 1 confront the support part 13B of the blade 13, air can efficiently flow through the openings 115 to the support part 13B. With this arrangement, heat generated in the scraping part 13C is transferred to the metal blade body 13A and support part 13B, and air flowing through the openings 115 over the support part 13B removes heat therefrom. Thus, the image forming device 1 can effectively cool the blade body 13A and scraping part 13C, further suppressing degradation of toner.

The intake duct 111 is disposed in the space between the exposure unit 17 and process unit 10, with the underside surface 17U of the exposure unit 17 forming the top surface of the intake duct 111. Thus, the image forming device 1 utilizes the space between the exposure unit 17 and process unit 10 for the intake duct 111, and the air flowing through this space can cool the exposure unit 17.

The sloped surface 111S provided in the image forming device 1 surfaces to guide air flowing toward the discharge duct 121 in the space between the exposure unit 17 and process unit 10 toward the process unit 10.

The left end 111L of the intake duct 111 is engaged in the first wall 61, and the right end 111R of the intake duct 111 is engaged in the second wall 62. In this way, the intake duct 111 is reliably fixed to the enclosure 6, and the openings 115 can be formed over a long distance in the left-right direction. Further, with the intake duct 111 coupling the first wall 61 and second wall 62 together with the linking segments 63, the rigidity of the image forming device 1 is enhanced.

Figure 6:
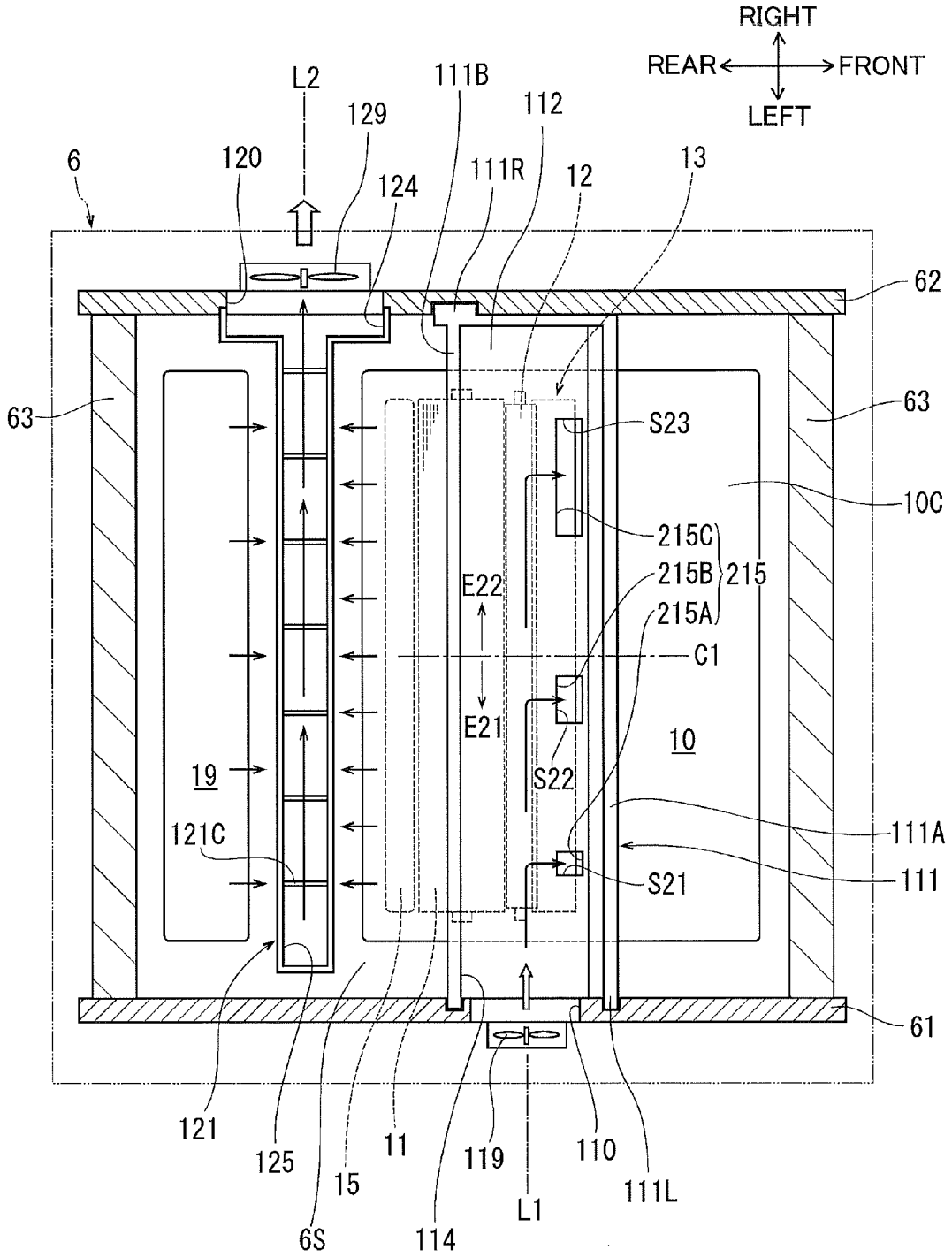
FIG. 6 is a partial enlarged cross-sectional view of an image forming device according to a second embodiment taken along a plane A-A in FIG. 2.

As shown in FIG. 6, an image forming device according to the second embodiment is further provided with an intake fan 119. In addition, the image forming device according to the second embodiment changes the openings 115 in the first embodiment to openings 215. The remaining structure of the second embodiment is identical to that described in the first embodiment, and like parts and components are designated with the same reference numerals to avoid duplicating description.

The intake fan 119 is disposed between the air intake 110 and the left side of the enclosure 6. The intake fan 119 introduces air outside the enclosure 6 into the intake duct 111 through the air intake 110. Accordingly, the pressure inside the intake duct 111 becomes higher than the negative pressure that the discharge fan 129 generates in the accommodating section 6S.

The openings 215 are configured of a rectangular hole 215A disposed on the left side of the opposing part 112, a rectangular hole 215B disposed in the center region, and a rectangular hole 215C disposed on the right side. Hence, the openings 215 are formed from a position in the accommodating section 6S near the first wall 61 on the left side to a position near the second wall 62 on the right side.

The openings 215 are divided among a first region E21 on the left side of the centerline C1, and a second region E22 on the right side of the centerline C1. The open area of the openings 215 in the first region E21 is the sum of the area S21 of the rectangular hole 215A and the area S22 of the rectangular hole 215B, while the open area of the opening 215 in the second region E22 is the area S23 of the rectangular hole 215C. Here, the area S23 in the second region E22 is greater than the sum of areas S21 and S22 in the first region E21.

If the open area provided in the first region E21 were equivalent to the open area in the second region E22 in the image forming device according to the second embodiment described above, air is more likely to be discharged from the first region E21 nearer the intake fan 119 than the second region E22 due to the intake fan 119 pushing air into the intake duct 111. However, in the image forming device according to the second embodiment, the area S23 in the second region E22 is set larger than the sum of areas S21 and S22 in the first region E21 so that equal amounts of air can be discharged from the first region E21 and the second region E22.

Therefore, the image forming device according to the second embodiment can achieve the same operational advantages described for the image forming device 1 according to the first embodiment.

While the invention has been described in detail with reference to first and second embodiments thereof, it would be apparent to those skilled in the art that many modifications and variations may be made therein without departing from the spirit of the invention, the scope of which is defined by the attached claims.

Figure 7A:
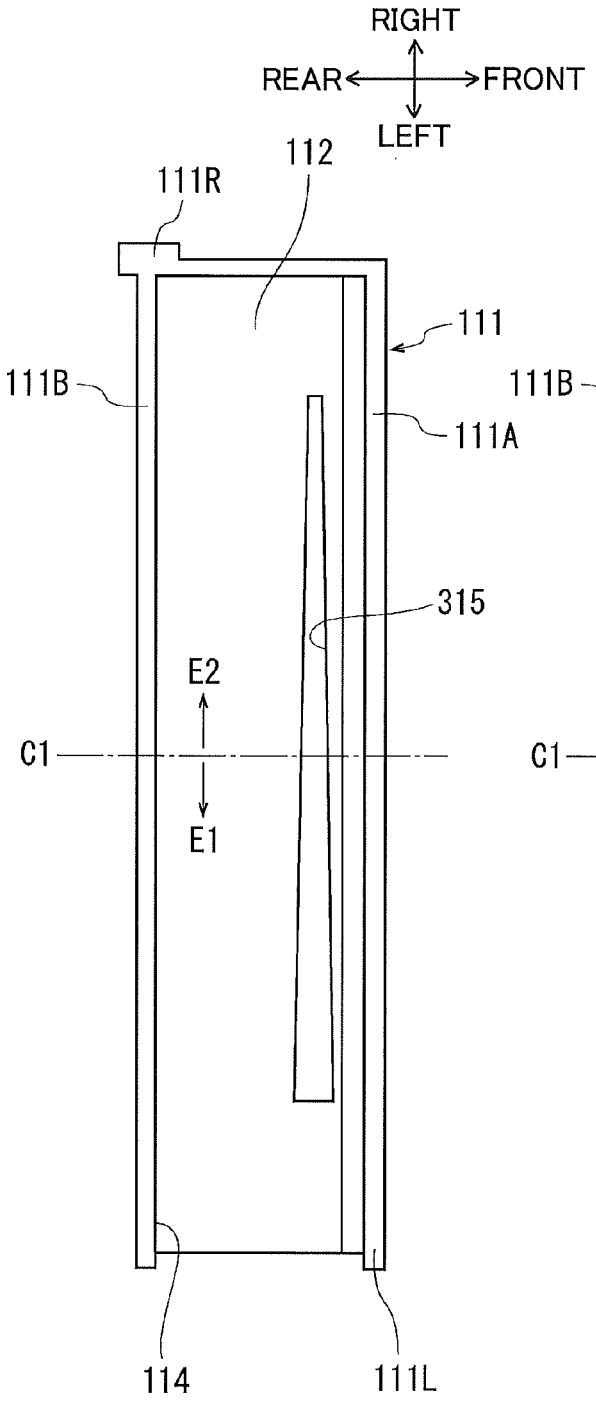
FIG. 7A is a top view of an intake duct provided in an image forming device according to a variation of embodiments.
Figure 7B:
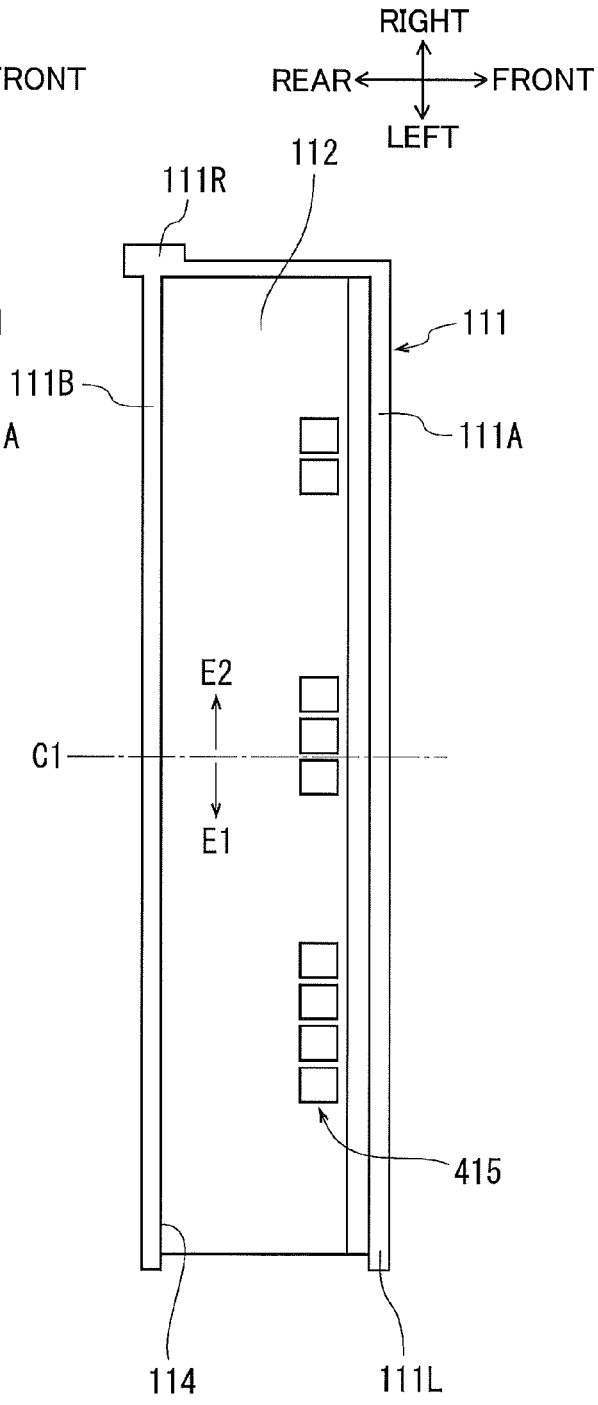
FIG. 7B is a top view of an intake duct of an image forming device according to a variation of embodiments.

For example, the openings formed in the opposing part 112 are not limited to the configurations of the openings 115 and openings 215 described in the first and second embodiments, but may be configured similarly to an opening 315 or openings 415 according to variations of the embodiments shown in FIGS. 7A and 7B. The opening 315 shown in FIG. 7A is a single elongate hole. The opening 315 tapers gradually from the left end toward the right end. The openings 415 shown in FIG. 7B include a plurality of rectangular holes having the same size and shape that are arranged linearly. The number of rectangular holes is different for the left side, the center region, and the right side of the opposing part 112. The same operational advantages described for the image forming device 1 according to the first embodiment can be achieved even when replacing the openings 115 with the opening 315 shown in FIG. 7A or openings 415 shown in FIG. 7B.

The openings in the opposing member may be formed either continuously or intermittently from one end of the opposing member to the other with respect to the first direction.

In the case that a plurality of openings is formed in the opposing part 112, when the open area of openings in the first region of the opposing part 112 is greater than the open area of openings in the second region, the sum of the areas of openings formed in the first region should be greater than the sum of the areas of openings formed in the second region.

As long as the process unit 10 possesses at least the photosensitive drum 11, the process unit 10 may form toner images with members other than the developing roller 12. Further, the process unit 10 may be configured such that the photosensitive drum 11 and case 10C can be independently removed from the enclosure 6.

The present invention is available for image forming devices, multifunction peripherals, and any other devices.

What is claimed is:

1. An image forming device comprising:

an image forming unit including:

a photosensitive member configured to rotate about an axis;

a developing roller configured to supply toner to the photosensitive member to form a toner image thereon; and a blade configured to regulate an amount of toner carried by the developing roller;

a first frame disposed in an upstanding posture and configured to support the image forming unit from one side in a first direction parallel to the axis and partition the image forming unit from atmosphere, an air intake being formed in the first frame to allow air communication between atmosphere and the image forming unit;

an intake duct elongated in the first direction, the intake duct having an opposing part in opposition to the image forming unit in a second direction perpendicular to the first direction, an opening being formed in the opposing part and air introduced into the intake duct flowing toward the image forming unit through the opening; and an exposure unit configured to expose the photosensitive member to a laser beam and form an electrostatic latent image on the photosensitive member for forming the toner image, the intake duct being disposed between the exposure unit and the image forming unit in the second direction, wherein the second direction is a vertical direction, the intake duct is disposed above the image forming unit and under the exposure unit; and wherein the opening opposes the blade and air introduced into the intake duct downwardly flows toward the blade through the opening.

2. The image forming device according to claim 1, wherein the air intake is provided on an extended line that passes through the intake duct in the first direction; and wherein an intermediate air intake is formed in the intake duct and is open to the air intake.

3. The image forming device according to claim 1, further comprising:

a discharge fan; and a second frame disposed in an upstanding posture and configured to support the image forming unit from another side in the first direction and partition the image forming unit from atmosphere, an air outlet being formed in the second frame to allow air communication between atmosphere and the image forming unit, wherein the discharge fan is configured to discharge air from the air outlet.

4. The image forming device according to claim 3, wherein the opening is formed from the one side to the another side of the opposing part in the first direction; and wherein, when the opening is divided among a first region disposed on the one side of the opposing part and a second region disposed on the another side of the opposing part, an open area of the opening in the first region is greater than an open area of the opening in the second region.

5. The image forming device according to claim 3, further comprising an intake fan configured to introduce air from atmosphere into the intake duct through the air intake, wherein the opening is formed from the one side to the another side of the opposing part in the first direction; and wherein, when the opening is divided among a first region disposed on the one side of the opposing part and a second region disposed on the another side of the opposing part, an open area of the opening in the second region is greater than an open area of the opening in the first region.

6. The image forming device according to claim 3, further comprising a discharge duct that is elongated in the first direction, air flowing into the discharge duct and being discharged from the air outlet.

7. The image forming device according to claim 6, wherein a discharge opening is formed from another side to one side of the discharge duct in the first direction, and air flowing through the opening toward the image forming unit enters the discharge duct through the discharge opening.

8. The image forming device according to claim 6, wherein the air outlet is provided on an extended line that passes through the discharge duct in the first direction; and wherein an intermediate air outlet is formed in the discharge duct and is open to the air outlet.

9. The image forming device according to claim 6, further comprising:

a conveying unit configured to convey a sheet in a conveying direction; and a transfer unit configured to transfer the toner image formed on the photosensitive member to the sheet, wherein the discharge duct is disposed in a position offset downstream of the intake duct in the conveying direction.

10. The image forming device according to claim 9, further comprising a fixing unit configured to apply heat and pressure to the sheet on which the toner image is transferred and fix the toner image to the sheet, wherein the discharge duct is disposed between the image forming unit and the fixing unit.

11. The image forming device according to claim 1, wherein the blade includes a blade body formed of a rubber material and configured to contact the developing roller and a support part formed of a metal material and configured of support the blade body; and wherein the opening opposes the support part.

12. The image forming device according to claim 1, wherein the intake duct is fixed to an underside surface of the exposure unit and includes a sloped surface that slopes continuously from the opposing part toward the image forming unit.

13. The image forming device according to claim 1, further comprising a second frame disposed in an upstanding posture and configured to support the image forming unit from another side in the first direction and partition the image forming unit from atmosphere, wherein one end of the intake duct is engaged in the first frame while another end of the intake duct is engaged in the second frame.

* * * * *